US006035873A

United States Patent [19]

Lin et al.

[11] Patent Number: 6,035,873

[45] Date of Patent: Mar. 14, 2000

[54] MULTIPLE-FOLD UMBRELLA HAVING GRADATIONALLY CONVEX TELESCOPIC SHAFT

[75] Inventors: Chung-Kuang Lin, Taipei; Jung-Jen Chang, Taipei Hsien, both of Taiwan

[73] Assignee: Fu Tai Umbrella Works, Ltd., Taipei Hsien, Taiwan

[21] Appl. No.: 09/115,852

[22] Filed: Jul. 15, 1998

[51] Int. Cl.[7] ..... A45B 19/00

[52] U.S. Cl. ..... 135/25.1; 135/25.4; 135/75; 403/377

[58] Field of Search ..... 135/25.1, 25.3, 135/25.31, 25.33, 25.4, 27, 29, 75; 403/109, 377

[56] References Cited

U.S. PATENT DOCUMENTS

| | | | |
|---|---|---|---|
| 1,474,821 | 11/1923 | Hartzell | 135/29 X |
| 2,124,842 | 7/1938 | Zierold et al. | 135/75 X |
| 4,687,012 | 8/1987 | Schultes et al. | 135/75 |
| 4,951,695 | 8/1990 | Yang | 135/29 |
| 5,551,463 | 9/1996 | Wang | 135/25.3 |
| 5,553,634 | 9/1996 | Yang | 135/25.3 |
| 5,615,697 | 4/1997 | Lin et al. | 135/37 X |
| 5,641,013 | 6/1997 | Wingfield | 135/25.32 X |
| 5,702,198 | 12/1997 | Kuo | 135/25.4 X |

*Primary Examiner*—Carl D. Friedman
*Assistant Examiner*—Winnie Yip

[57] ABSTRACT

A multiple-fold umbrella includes: a central shaft consisting of a plurality of tubes telescopically engageable with one another having a top or innermost tube having a smallest diameter or width and having a cross section formed with a plurality of quadrants each concave radially inwardly towards a longitudinal axis of the central shaft with at least two neighboring concave quadrants converging to form a ridge portion and a socket defined between the two neighboring concave quadrants for storing a spring catch in the socket, with the tubes gradationally curving their quadrants radially outwardly from their concave quadrants to form a lowest or outermost tube having a cross section of circular shape for a smooth holding by the umbrella user; and a rib assembly consisting of at least a top rib, a stretcher rib, an intermediate rib, an outer connecting rib and an inner connecting rib pivotally connected with one another and connected to an upper notch and a runner on the central shaft, with the inner connecting rib formed as a slim linking plate having an elongate reinforcing projection longitudinally formed on the inner connecting rib for enhancing the strength of the rib assembly.

9 Claims, 5 Drawing Sheets

MULTIPLE-FOLD UMBRELLA HAVING GRADATIONALLY CONVEX TELESCOPIC SHAFT

BACKGROUND OF THE INVENTION

For shortening an umbrella length and volume when folded for convenient carrying or storage purpose, the ribs of the rib assembly can be made as multiple folds and the central shaft be made as consisting of plural tubes which may be telescopically engageable with one another.

When the umbrella is opened, a spring catch should be provided in the central shaft for locking a runner of the ribs on the spring catch, which is depressed into the central shaft when retracting the tubes and closing the umbrella. The top tube of the telescopic central shaft should have a minimal diameter or width for a multiple-fold umbrella such as a four-fold or five-fold umbrella, thereby causing a great difficulty to install the spring catch in such a small top tube of the central shaft.

U.S. Pat. No. 4,739,783 disclosed a shortening link means of multiple-fold umbrella including a rib assembly having a third link (3) slidably engageable with a fourth link (4). The link (3) is slidably held in link (4) to thereby weaken the strength and stability of the rib assembly. Meanwhile, when opening or closing the umbrella, the extending or retraction of the ribs are initiated merely by the first link (1) and second link (2), without the aids of the third link (3) since the outer end (32) of the third link (3) is free moved in the fourth link (4) having no linkage connection therebetween. So, the rib assembly of such a conventional multiple umbrella can not be opened or closed very smoothly.

The present inventor has found the drawbacks of the conventional umbrella and invented the present multiple-fold umbrella.

SUMMARY OF THE INVENTION

The object of the present invention is to provide a multiple-fold umbrella including: a central shaft consisting of a plurality of tubes telescopically engageable with one another having a top or innermost tube having a smallest diameter or width and having a cross section formed with a plurality of quadrants each concave radially inwardly towards a longitudinal axis of the central shaft with at least two neighboring concave quadrants converging to form a ridge portion and a socket defined between the two neighboring concave quadrants for storing a spring catch in the socket, with the tubes gradationally curving their quadrants radially outwardly from their concave quadrants to form a lowest or outermost tube having a cross section of circular shape for a smooth holding by the umbrella user; and a rib assembly consisting of at least a top rib, a stretcher rib, an intermediate rib, an outer connecting rib and an inner connecting rib pivotally connected with one another and connected to an upper notch and a runner on the central shaft, with the inner connecting rib formed as a slim linking plate having an elongate reinforcing projection longitudinally formed on the inner connecting rib for enhancing the strength of the rib assembly.

DETAILED DESCRIPTION

Figures 1, 2:
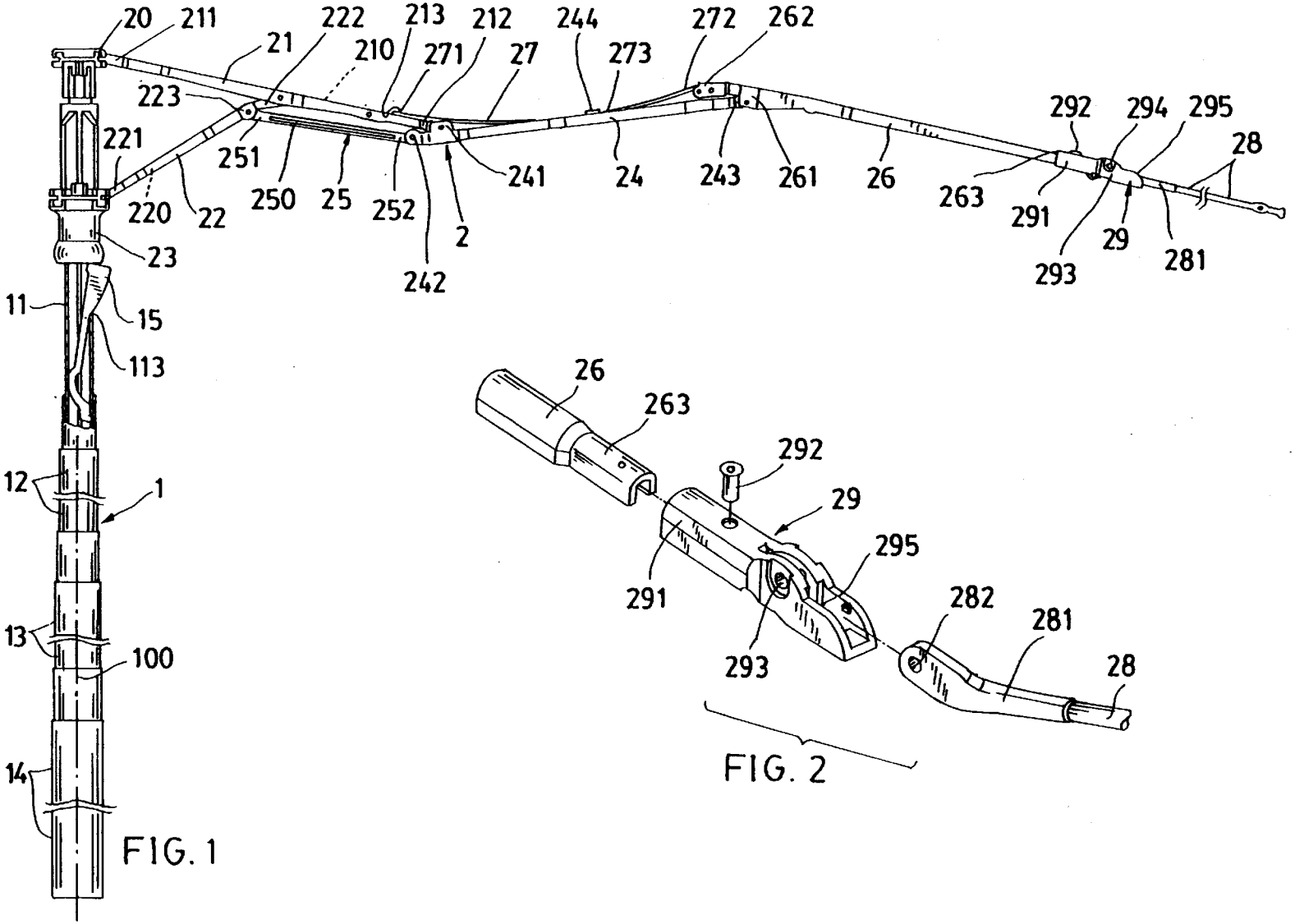
FIG. 1 is an illustration showing an open umbrella of the present invention.
FIG. 2 is a perspective view of a plastic joint and the relevant ribs of the present invention.

As shown in FIGS. 1~15, the present invention comprises: a central shaft 1, and a rib assembly 2 pivotally secured to the central shaft 1 for securing an umbrella cloth (not shown) on the rib assembly 2.

The central shaft 1 includes: an upper or inner tube 11 having a spring catch 15 resiliently held in the upper tube 11, a first intermediate tube 12 telescopically disposed on an outside of the upper tube 11 and positioned under the upper tube 11 when opening the umbrella, a second intermediate tube 13 telescopically disposed on an outside of the first intermediate tube 12 and positioned under the first intermediate tube 12 when opening the umbrella, and a lower or outer tube 14 telescopically disposed on an outside of the second intermediate tube 13 and positioned under the second intermediate tube 13 when opening the umbrella, and having a grip (not shown) secured to the lower tube 14 to be grasped by an umbrella user.

The present invention may be made of light materials such as aluminum or titanium alloys, reinforced plastic materials or other suitable metallic materials.

The upper (or inner) tube 11 has its upper end portion 111 secured with an upper notch 20 of the rib assembly 2 and has a lower enlarged portion 112 slightly enlarged from a lower end portion of the upper tube 11, and telescopically engageable with the first intermediate tube 12.

Figure 4:
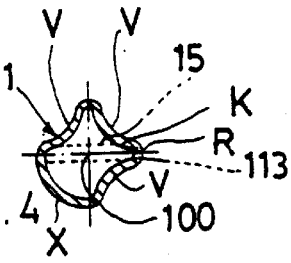
FIG. 4 is a cross sectional drawing of the shaft from 4—4 direction of FIG. 3.

The upper tube 11 has a cross section consisting of three concave quadrants V concave radially inwardly towards the longitudinal axis 100 of the central shaft 1 and a convex quadrant X convex radially outwardly from the longitudinal axis 100 as shown in FIG. 4, with two neighboring concave quadrants V forming a ridge portion R between the two neighboring concave quadrants V having a socket K defined in the ridge portion R confined between the two neighboring concave quadrants V for storing the spring catch 15 in the socket K and within an interior of the upper tube 11 when closing the umbrella, with the spring catch 15 resiliently protruding outwardly through a slot 113 cut in the upper tube 11 for locking a runner 23 of the rib assembly 2 when opening the umbrella as shown in FIG. 1.

Figure 6:
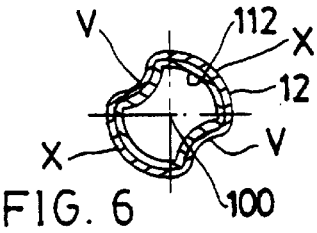
FIG. 6 is a sectional drawing from 6—6 direction of FIG. 3.
Figure 7:
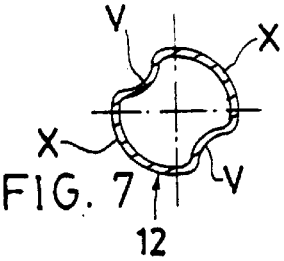
FIG. 7 is a sectional drawing from 7—7 direction of FIG. 3.
Figure 8:
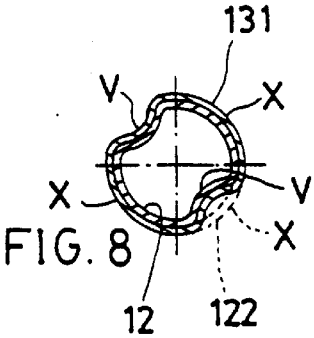
FIG. 8 is a sectional drawing from 8—8 direction of FIG. 3.

The first intermediate tube 12 has a cross section consisting of two concave quadrants V concave diametrically inwardly towards the longitudinal axis 100 of the central shaft as shown in FIG. 6, and two convex quadrants X convex diametrically outwardly from the longitudinal axis 100 for slidably or telescopically engaging the lower enlarged portion 112 of the upper tube 11, which is also consisting of two concave quadrants V and two convex quadrants X respectively diametrically circumferentially forming the lower enlarged portion 112 of the upper tube 11, within the first intermediate tube 12.

Figure 3:
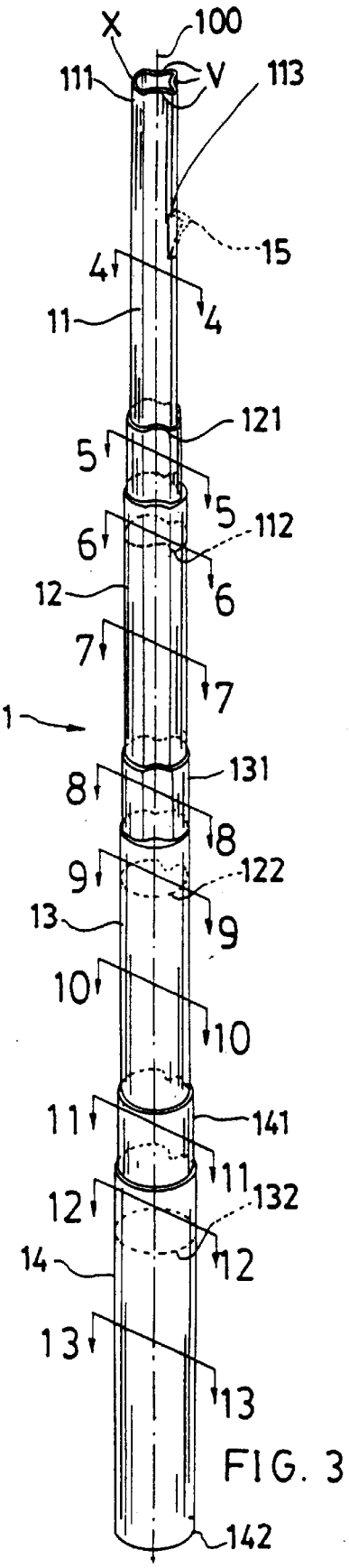
FIG. 3 is a perspective view of the central shaft of the present invention.
Figure 5:
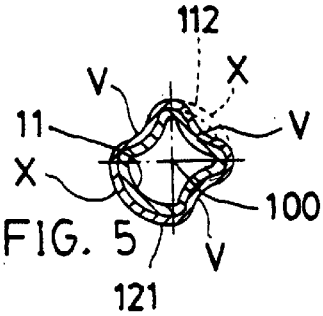
FIG. 5 is a sectional drawing from 5—5 direction of FIG. 3.
Figure 9:
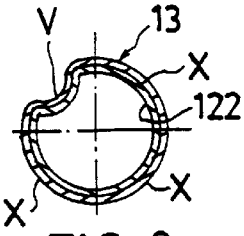
FIG. 9 is a sectional drawing from 9—9 direction of FIG. 3.

The first intermediate tube 12 has an upper contracted portion 121 slightly contracted from the first intermediate tube having a cross section formed as a shape corresponding to that of the upper tube 11 to be telescopically engageable with the upper tube 11 within the upper contracted portion 121 as shown in FIGS. 3, 5; and a lower enlarged portion 122 slightly enlarged from a lower end portion of the first intermediate tube 12 to be telescopically engageable in the second intermediate tube 13 as shown in FIG. 9.

Figure 10:
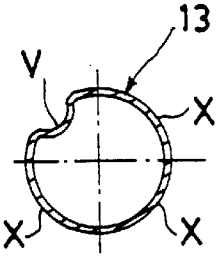
FIG. 10 is a sectional drawing from 10—10 direction of FIG. 3.

The second intermediate tube 13 has a cross section consisting of one concave quadrant V concaved radially inwardly towards the longitudinal axis 100 of the central shaft 1, and three convex quadrants X convex radially outwardly to circumferentially form a partial circular shape as shown in FIG. 10 for telescopically engaging the lower enlarged portion 122 of the first intermediate tube 12 having a cross section formed as a shape corresponding to that of the second intermediate tube 13 as shown in FIG. 9.

Figure 12:
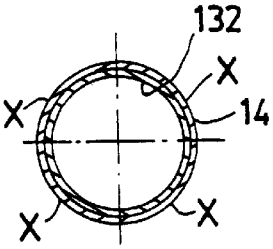
FIG. 12 is a sectional drawing from 12—12 direction of FIG. 3.

The second intermediate tube 13 has an upper contracted portion 131 slightly contracted from the second intermediate tube 13 and formed as a shape corresponding to that of the first intermediate tube 12 (FIG. 8) to be telescopically engageable with the first intermediate tube 12 in the upper contracted portion 131; and a lower enlarged portion 132 slightly enlarged from the second intermediate tube 13 to be telescopically engageable in the lower (or outer) tube 14 as shown in FIG. 12.

Figure 11:
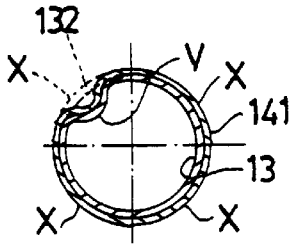
FIG. 11 is a sectional drawing from 11—11 direction of FIG. 3.
Figure 13:
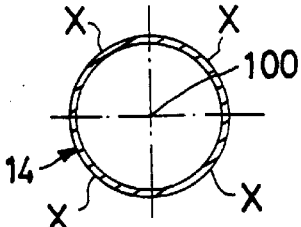
FIG. 13 is a sectional drawing from 13—13 direction of FIG. 3.

The lower (or outer) tube 14 has a cross section of circular shape (having four convex quadrants X circumferentially forming the circle as shown in FIG. 13), having an upper portion of the lower tube 14 telescopically engageable with the lower enlarged portion 132 of the second intermediate tube 13 having a cross section of circular shape as shown in FIG. 12, and having an upper contracted portion 141 slightly contracted from the upper portion of the lower tube 14 and formed as a shape corresponding to that of the second intermediate tube 13 for telescopically engaging the second intermediate tube 13 in the upper contracted portion 141 of the lower tube 14 as shown in FIG. 11.

Due to the gradationally or gradually outward curving of the concave quadrants V from the upper (inner) tube 11 (having three concave quadrants V) towards the lower (outer) tube 14 (having four convex quadrants X), all the tubes 11~14 are telescopically engageable with one another (FIG. 15) by the concave or convex circumferential surfaces of the tubes for preventing twisting or vibration during folding or unfolding of the tubes of the umbrella. The inner tube 11 provides a socket K for storing the spring catch 15 therein even its inside diameter is such small. It indicates an effective use for the "space" of the interior in the inner tube 11 for holding the catch 15 therein. After gradational or gradual curving of the tube circumference surfaces, the outer tube 14 becomes a circular surface which is smoothly engageable with the circular hole 231 in the runner 23 for a smooth sliding or telescopic movements of the tubes 11~14 of the central shaft 1 ensuring a reliable opening or closing operation of the umbrella. Meanwhile, the circular surface of the outer tube 14 after being shortened and folded (FIG. 14) will enhance a smooth comfortable touch feeling on the shaft surface by the umbrella user.

The rib assembly 2 and the tubes 11~14 of the central shaft 1 are provided for a four-fold umbrella or multiple-fold umbrella as shown in FIGS. 1~14. The enlarged portion 112, 122, 132 and the contracted portion 121, 131, 141 of the relevant tubes provide a limiting stopper when extending the tube for opening the umbrella.

Figure 14:
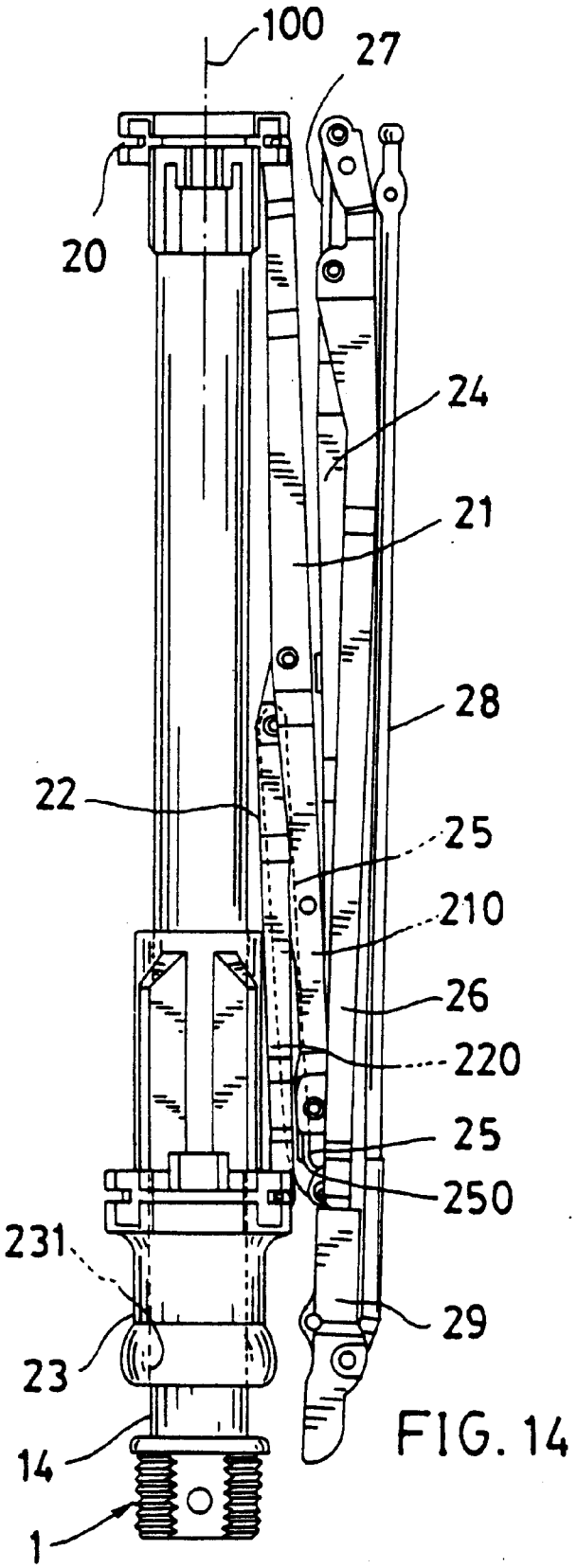
FIG. 14 shown a folded umbrella of the present invention.
Figure 15:
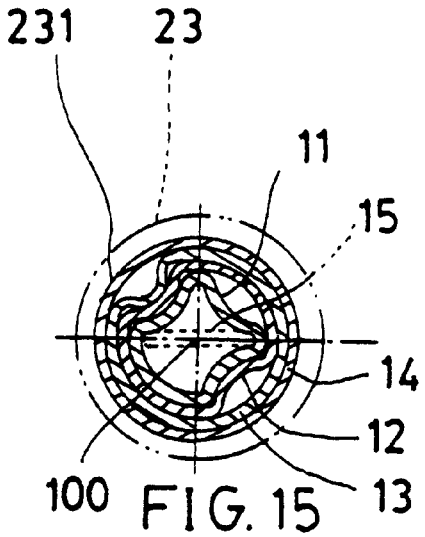
FIG. 15 is a cross sectional drawing of the central shaft when folded.
Figure 16:
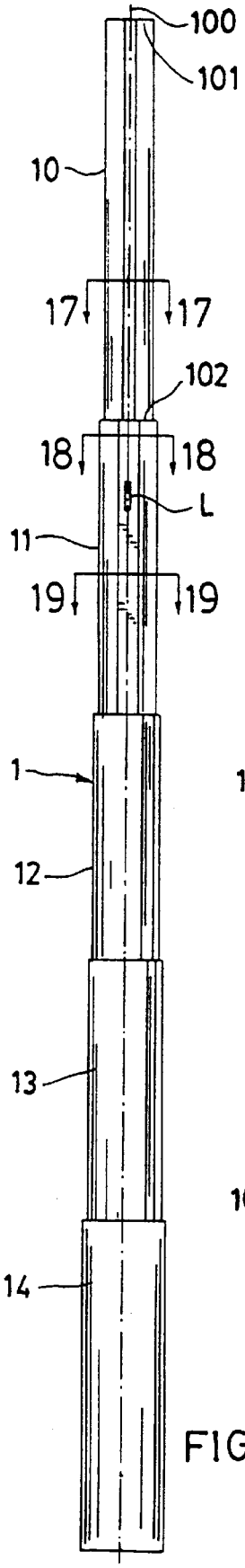
FIG. 16 shows another preferred shaft of the present invention.

The rib assembly 2 as shown in FIGS. 1, 2 and 14 includes: a top rib 21 having its inner portion 211 pivotally secured to an upper notch 20 fixed on a top portion of the upper tube 11, a stretcher rib 22 having an inner portion 221 pivotally connected to the runner or lower runner 23 slidably held on the central shaft 1 and having an outermost end portion 222 of the stretcher rib 22 pivotally connected with a middle portion of the top rib 21, an intermediate rib 24 having an inner portion 241 of the intermediate rib 24 pivotally connected with an outermost end portion 212 of the top rib 21, an inner connecting rib 25 having an inner portion 251 pivotally connected with an outer portion 223 of the stretcher rib 22 and an outer portion 252 pivotally connected with an innermost end portion 242 of the intermediate rib 24, an outer connecting rib 26 having an inner portion 261 of the rib 26 pivotally connected with an outer portion 243 of the intermediate rib 24 and having an outer portion 263 of the rib 26 pivotally connected with a tail rib 28 by a plastic joint 29, and a spring rod 27 having an inner spring end 271 pivotally connected to an outer portion 213 of the top rib 21 and an outer spring end 272 pivotally connected with an outermost end portion 262 of the outer connecting rib 26 with a middle spring portion 273 slidably held in a collar 244 formed on a middle portion of the intermediate rib 24. All the ribs may be made of aluminum alloy or other light weight materials.

The inner connecting rib 25 is a slim linking plate having an elongate reinforcing projection 250 longitudinally formed on the inner connecting rib 25 for reinforcing the strength thereof.

The inner connecting rib 25 is juxtapositioned under the top rib 21 to form a parallelogram linkage among the top rib 21, the stretcher rib 22, the inner connecting rib 25 and the intermediate rib 24 for smoothly extending the rib assembly 2 or for retracting the same for opening or closing the umbrella.

The inner connecting rib 25 as formed as a slim linking plate is snugly received into a U-shaped groove 220 recessed in the stretcher rib 22 and a U-shaped groove 210 recessed in the top rib 21 as shown in FIG. 14 for minimizing a folding volume of a folded umbrella as shown in FIG. 14.

The plastic joint 29 as shown in FIGS. 2, 1 includes: an inner adapter 291 secured to an outer portion 263 of the outer connecting rib 26 by rivet 292, a pair of lugs 293 formed on a middle portion of the joint 29 for pivotally connecting an inner pivotal portion 281 of the tail rib 28 by a pivot 294 passing through a pivot hole 282 formed through the inner pivotal portion 281 of the tail rib 28, and a U-shaped groove 295 recessed in the middle portion of the joint 29 for resting the tail rib 28 in the U-shaped groove 295 when the tail rib 28 is horizontally extended when opening an umbrella.

When the umbrella is closed as shown in FIG. 14, the tail rib 28 is upwardly biased to approximate the outer connecting rib 26 for minimizing the folding volume of the umbrella, also for folding or "clamping" an outer portion of the umbrella cloth (not shown) in between the ribs 28, 26 for making the folded umbrella neatly.

For a better strength of the inner pivotal portion 281 of the tail rib 28, the pivotal portion 281 may be made of steel material to be joined with an innermost end of the tail rib 28.

Since the rib assembly 2 of the present invention is formed with the linkage of the plural ribs 21, 22, 24, 25, 26, 27, 28 pivotally connected with one another so as for overcoming the loosening, unstable slidable telescopic ribs as disclosed in U.S. Pat. No. 4,739,783, the ribs 2 can be operated stably, reliably and smoothly with better strength and longer life.

Figure 17:
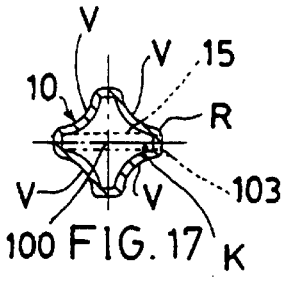
FIG. 17 is a sectional drawing from 17—17 direction of FIG. 16.
Figure 18:
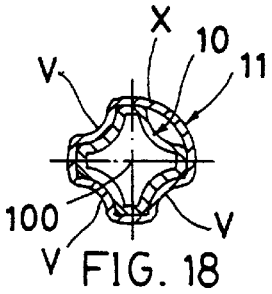
FIG. 18 is a sectional drawing from 18—18 direction of FIG. 16.
Figure 19:
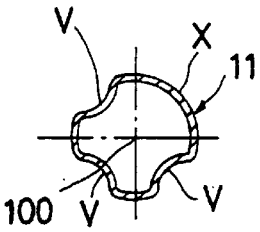
FIG. 19 is a sectional drawing from 19—19 direction of FIG. 16.

As shown in FIGS. 16~23, an uppermost tube 10, having a smaller diameter or width than the upper tube 11 as aforementioned, is telescopically engageable in the upper tube 11 and has a cross section consisting of four concave quadrants V concave radially inwardly towards the longitudinal axis 100, with every two neighboring concave quadrants V forming a ridge portion R having a socket K formed in the ridge portion R for storing a spring catch 15 therein (FIG. 17). The spring catch 15 is protruded outwardly through a slot 103 cut in the tube 10 for locking the runner 23 when opening the umbrella.

The uppermost (or top) tube 10 has an upper portion 101 secured with the upper notch 20 of the rib assembly 2, and a lower portion 102 telescopically engageable with the upper tube 11.

Figure 20:
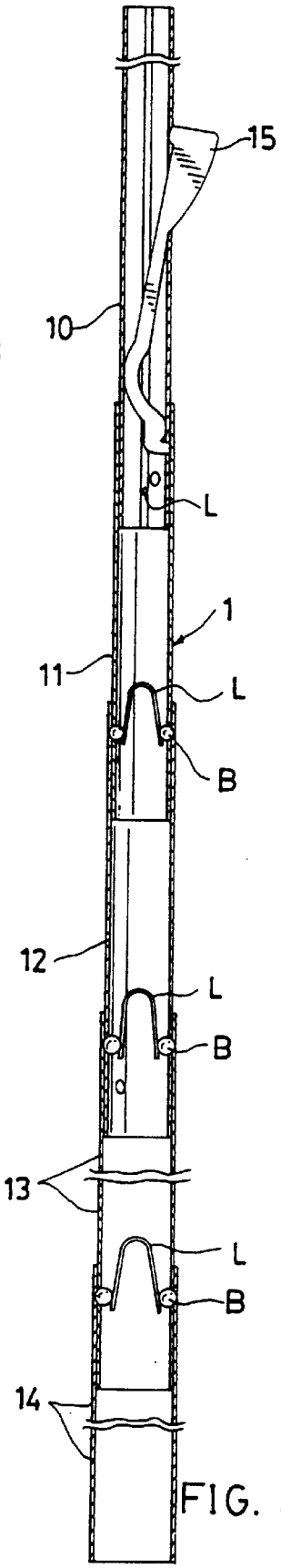
FIG. 20 is a longitudinal sectional drawing of FIG. 16.
Figure 22:
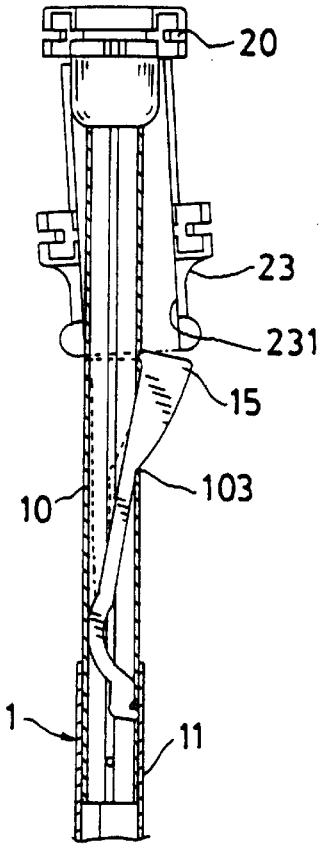
FIG. 22 is a partial sectional drawing of the upper portion of the present invention having the shaft of FIG. 21.
Figure 21:
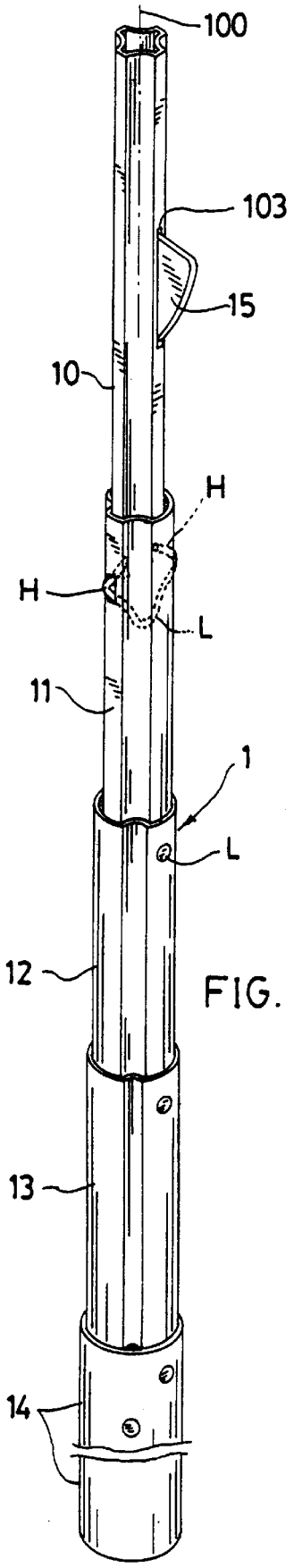
FIG. 21 is a perspective view of FIG. 16.

For preventing the separation of the two neighboring telescopic tubes, a spring lock L is resiliently held at the coupling portions of the two tubes as shown in FIG. 20, each spring lock L resiliently urging a pair of balls B each ball B coupling two ball holes respectively formed in the two corresponding tubes telescopically engageable with each other. Or, the spring lock L may be formed with two hook portions H for resiliently coupling the two neighboring telescopic tubes such as the tubes 10, 11 as shown in FIG. 21.

Figure 23:
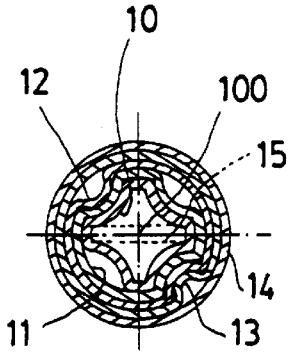
FIG. 23 is a cross sectional drawing of the shaft when folded from FIG. 21.

After folding the umbrella by retracting the tubes 10, 11, 12, 13, 14 as shown in FIG. 23, an outer circular shape of the outer tube 14 is presented for a smooth appearance of the shaft 1.

Figure 24:
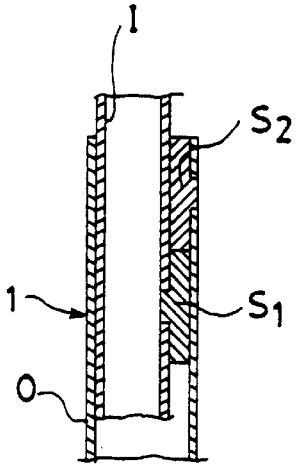
FIG. 24 shows another limiting method of an inner and an outer tube of the shaft.

For coupling two telescopic tubes such as an inner tube I and an outer tube O, each tube is fixed with a stopper S1 or S2 for preventing escape (separation) of one tube from the other tube as shown in FIG. 24.

The present invention may be modified without departing from the spirit and scope of the present invention.

What is claimed is:

1. A multiple-fold umbrella comprising:

a central shaft including: an upper tube having a spring catch resiliently held in the upper tube, a first intermediate tube telescopically disposed on an outside of the upper tube and positioned under the upper tube when opening the umbrella, a second intermediate tube telescopically disposed on an outside of the first intermediate tube and positioned under the first intermediate tube when opening the umbrella, and a lower tube telescopically disposed on an outside of the second intermediate tube and positioned under the second intermediate tube when opening the umbrella; and a rib assembly including: a top rib pivotally secured to an upper notch fixed on a top portion of the upper tube, a stretcher rib pivotally connected to a runner slidably held on the central shaft and pivotally connected to the top rib, an intermediate rib pivotally connected with the top rib, an inner connecting rib pivotally connected with the stretcher rib and pivotally connected with the intermediate rib, an outer connecting rib pivotally connected with the intermediate rib and pivotally connected with a tail rib through a plastic joint, and a spring rod pivotally connected to the top rib and pivotally connected with the outer connecting rib, the improvement which comprises:

said upper tube having a cross section consisting of three concave quadrants concave radially inwardly towards a longitudinal axis of the central shaft and a convex quadrant convex radially outwardly from the longitudinal axis, with two neighboring concave quadrants forming a ridge portion between the two neighboring concave quadrants having a socket defined in the ridge portion and confined between the two neighboring concave quadrants for storing the spring catch in the socket and within an interior of the upper tube when closing the umbrella, with the spring catch resiliently protruding outwardly through a slot cut in the upper tube for locking the runner of the rib assembly when opening the umbrella;

said first intermediate tube having a cross section consisting of two concave quadrants concave diametrically inwardly towards the longitudinal axis of the central shaft, and two convex quadrants convex diametrically outwardly from the longitudinal axis telescopically engaging the upper tube within said first intermediate tube;

said second intermediate tube having a cross section consisting of one concave quadrant concave radially inwardly towards the longitudinal axis of the central shaft, and three convex quadrants convex radially outwardly to circumferentially form a partial circular shape for telescopically engaging the first intermediate tube within said second intermediate tube; and said lower tube having a cross section of circular shape and telescopically engaging with the second intermediate tube.

2. A multiple-fold umbrella according to claim 1, wherein said inner connecting rib is a slim linking plate having an elongate reinforcing projection longitudinally formed on the inner connecting rib for reinforcing the strength thereof; said inner connecting rib juxtapositioned under the top rib and operatively forming a parallelogram linkage with the top rib, the stretcher rib, the inner connecting rib and the intermediate rib for smoothly extending the rib assembly; said inner connecting rib snugly received in the stretcher rib and in the top rib for minimizing a folding volume of the umbrella when folded.

3. A multiple-fold umbrella according to claim 1, wherein said plastic joint includes: an inner adapter secured to an outer portion of the outer connecting rib, a pair of lugs formed on a middle portion of the joint for pivotally connecting an inner pivotal portion of the tail rib and a U-shaped groove recessed in the middle portion of the joint for resting the tail rib in the U-shaped groove when the tail rib is horizontally extended when opening an umbrella.

4. A multiple-fold umbrella according to claim 1, wherein said first intermediate tube, having the cross section consisting of two concave quadrants concave diametrically inwardly towards the longitudinal axis of the central shaft and two convex quadrants convex diametrically outwardly from the longitudinal axis, is telescopically engaged with a lower enlarged portion of the upper tube, which is consisting of two concave quadrants and two convex quadrants respectively diametrically circumferentially forming the lower enlarged portion of the upper tube.

5. A multiple-fold umbrella according to claim 1, wherein said first intermediate tube has an upper contracted portion slightly contracted from the first intermediate tube having a cross section formed as a shape corresponding to that of the upper tube to be telescopically engaged with the upper tube within the upper contracted portion of the first intermediate tube; and a lower enlarged portion slightly enlarged from a lower end portion of the first intermediate tube to be telescopically engaged in the second intermediate tube.

6. A multiple-fold umbrella according to claim 5, wherein said second intermediate tube has the cross section consisting of one concave quadrant concave redially inwardly towards the longitudinal axis of the central shaft, and three convex quadrants convex radially outwardly to circumferentially form a partial circular shape for telescopically engaging the lower enlarged portion of the first intermediate tube having a cross section formed as a shape corresponding to that of the second intermediate tube.

7. A multiple-fold umbrella according to claim 6, wherein said second intermediate tube has an upper contracted portion slightly contracted from the second intermediate tube and formed as a shape corresponding to that of the first intermediate tube to be telescopically engaged with the first intermediate tube in the upper contracted portion of the second intermediate tube; and a lower enlarged portion slightly enlarged from the second intermediate tube to be telescopically engaged in the lower tube.

8. A multiple-fold umbrella according to claim 7, wherein said lower tube has the cross section of circular shaft, having an upper portion of the lower tube telescopically engaged with the lower enlarged portion of the second intermediate tube having a cross section of circular shape, and having an upper contracted portion slightly contracted from the upper portion of the lower tube and formed as a shape corresponding to that of the second intermediate tube for telescopically engaging the second intermediate tube in the upper contracted portion of the lower tube.

9. A multiple-fold umbrella comprising:

a central shaft including: an uppermost tube having a spring catch resiliently held in the uppermost tube, an upper tube telescopically disposed on an outside of the uppermost tube and positioned under said uppermost tube when opening the umbrella, a first intermediate tube telescopically disposed on an outside of the upper tube and positioned under the upper tube when opening the umbrella, a second intermediate tube telescopically disposed on an outside of the first intermediate tube and positioned under the first intermediate tube when opening the umbrella, and a lower tube telescopically disposed on an outside of the second intermediate tube and positioned under the second intermediate tube when opening the umbrella, with every two neighboring tubes having two stoppers respectively formed in the two neighboring tubes for preventing separation thereof; and a rib assembly including: at least a top rib pivotally secured to an upper notch fixed on a top portion of the uppermost tube, a stretcher rib pivotally connected to a runner slidably held on the central shaft and pivotally connected to the top rib;

the improvement which comprises:

said uppermost tube having a cross section consisting of four concave quadrants concave radially inwardly towards a longitudinal axis of the central shaft, with every two neighboring concave quadrants forming a ridge portion having a socket formed in the ridge portion for storing a spring catch which is protruded outwardly from the uppermost tube for locking said runner when opening the umbrella;

said upper tube having a cross section consisting of three concave quadrants concave radially inwardly towards the longitudinal axis of the central shaft and a convex quadrant convex radially outwardly from the longitudinal axis;

said first intermediate tube having a cross section consisting of two concave quadrants concave diametrically inwardly towards the longitudinal axis of the central shaft, and two convex quadrants convex diametrically outwardly from the longitudinal axis for telescopically engaging the upper tube within said first intermediate tube;

said second intermediate tube having a cross section consisting of one concave quadrant concave radially inwardly towards the longitudinal axis of the central shaft, and three convex quadrants convex radially outwardly to circumferentially form a partial circular shape for telescopically engaging the first intermediate tube within said second intermediate tube; and said lower tube having a cross section of circular shape and telescopically engaging with the second intermediate tube.

* * * * *